United States Patent [19]

LePoire

[11] Patent Number: 4,524,960

[45] Date of Patent: Jun. 25, 1985

[54] ADJUSTABLE JIG

[76] Inventor: Robert A. LePoire, 2200 Barritt, Lansing, Mich. 48912

[21] Appl. No.: 507,300

[22] Filed: Jun. 24, 1983

Related U.S. Application Data

[63] Continuation-in-part of Ser. No. 245,970, Mar. 20, 1981, abandoned.

[51] Int. Cl.[3] ..... B25B 1/10

[52] U.S. Cl. ..... 269/45; 269/208; 269/95; 269/244; 269/910

[58] Field of Search ..... 269/8, 45, 244, 95, 269/289 R, 303-305, 315, 319, 900, 208, 60; 51/216 R; 248/206 R, 206 A

[56] References Cited

U.S. PATENT DOCUMENTS

| | | | |
|---|---|---|---|
| 1,475,618 | 11/1923 | Anderson | 269/208 |
| 1,765,321 | 6/1930 | Bodmer | 269/244 |
| 2,383,008 | 8/1945 | Meister | 269/8 |
| 2,676,504 | 4/1954 | Brugge et al. | 269/8 |
| 3,142,787 | 7/1964 | Levesque | 269/8 |
| 3,428,305 | 2/1969 | Bohn | 269/8 |
| 3,854,711 | 12/1974 | Dong | 269/8 |
| 3,991,478 | 11/1976 | Stone | 269/60 |
| 4,125,251 | 11/1978 | Jamieson | 269/900 |
| 4,157,819 | 6/1979 | Meyer | 269/900 |

*Primary Examiner*—Robert C. Watson

*Attorney, Agent, or Firm*—Malcolm R. McKinnon

[57] ABSTRACT

An adjustable jig incorporating combined magnetic and mechanical means for adjustably mounting the jig on a workpiece support whereby the jig may be utilized to locate and maintain the correct positional relationship between components of work during assembly and manufacture thereof.

6 Claims, 18 Drawing Figures

FIG. 1.
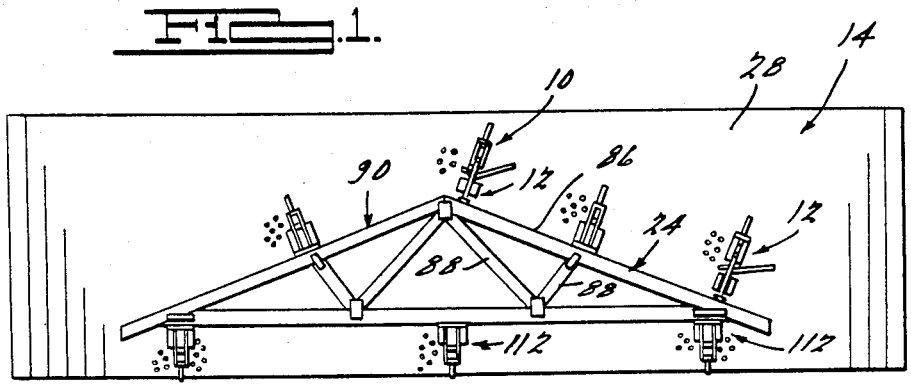
FIG. 2.
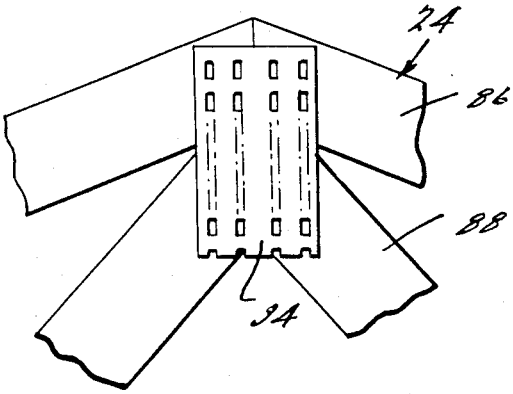
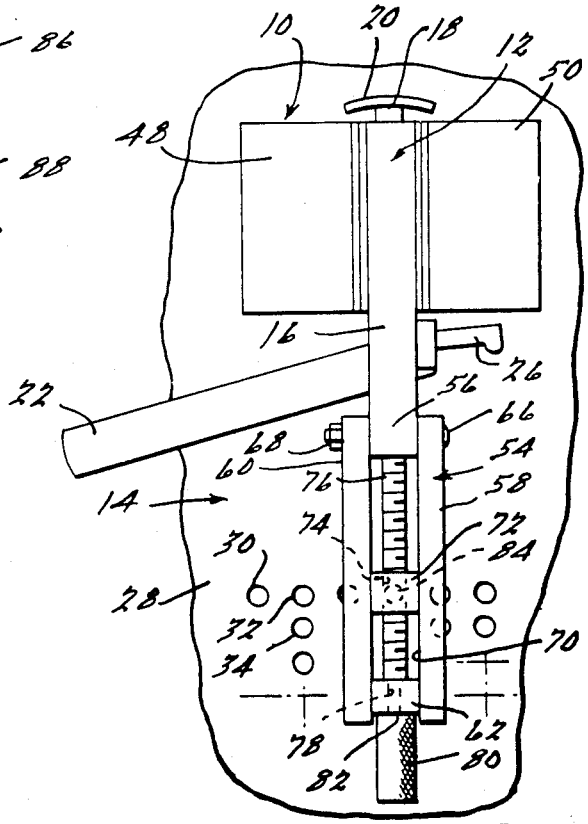
FIG. 3.

FIG. 4.
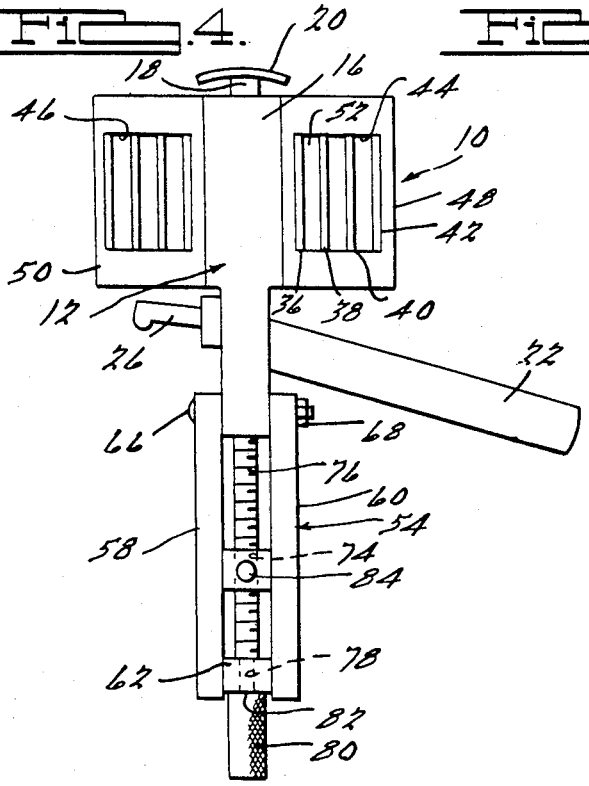
FIG. 5.
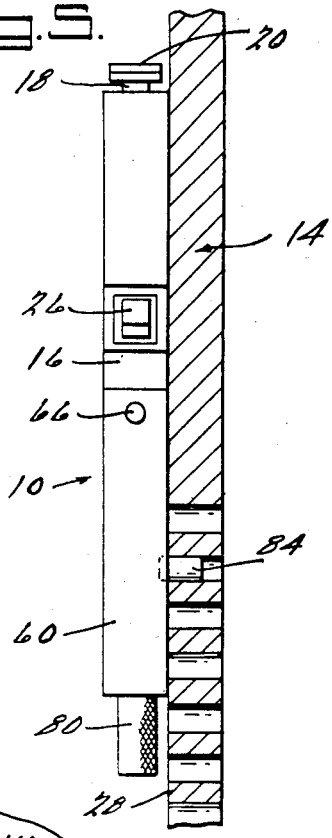
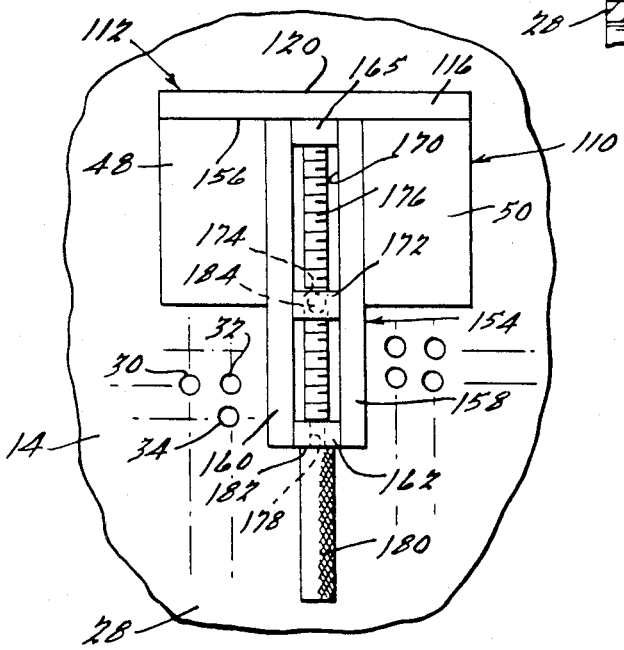
FIG. 6.

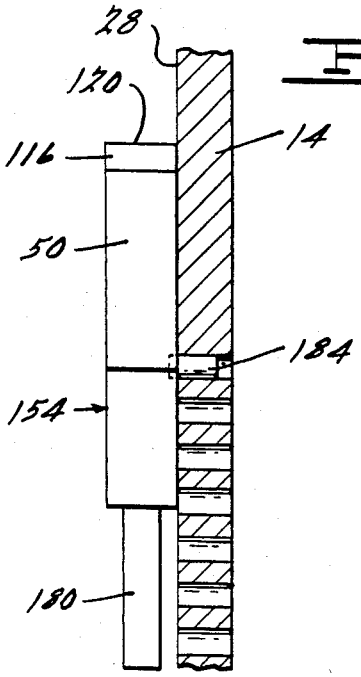
FIG. 7.
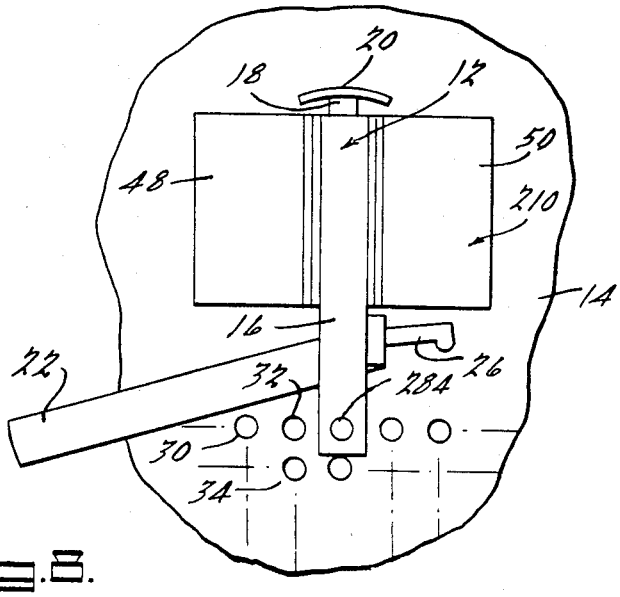
FIG. 8.
FIG. 9.
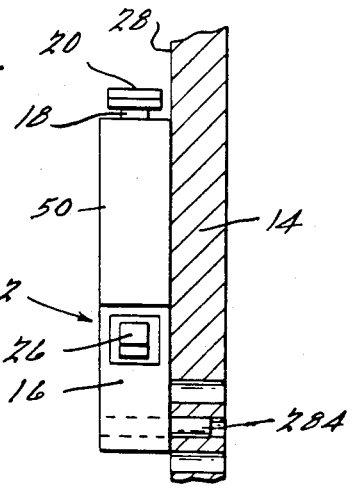

ADJUSTABLE JIG

BRIEF SUMMARY OF THE INVENTION

This application is a continuation-in-part of the applicant's co-pending application, Ser. No. 245,970, filed Mar. 20, 1981 now abandoned for Adjustable Mounting Means.

This invention relates to workpiece locating and clamping apparatus, and, more particularly, to an improved adjustable jig incorporating combined magnetic and mechanical means for adjustably mounting the jig on a workpiece support whereby the jig may be utilized to locate and maintain the correct positional relationship between components of work during assembly and manufacture thereof on a workpiece support. While the jig embodying the present invention is particularly adapted for use in the manufacture of prefabricated wooden roof and floor truss configurations for residential and commercial structures, it will be understood that the present invention is applicable to other uses.

As is well known in the art, in the manufacture of prefabricated wooden roof and floor truss configurations, the wooden components of the truss configurations, such as the chords and webs, are initially clamped in the desired position between a clamp and an associated stop on a relatively large table or other workpiece support after which connector plates are embedded in the wooded components of the truss configuration at the joints of the truss components while the truss components are held on the support in the clamped condition whereby the components of the truss configuration are permanently joined together. Heretofore, the clamps and stops have usually been mounted on the workpiece support through the agency of bolts which pass through the clamps or stops and project through slots or holes in the support, the bolts being retained by female threaded members, such as conventional nuts. In such prior devices, when it is desired to change the set up to accommodate a different size or type of truss, in order to adjust the clamps or stops relative to the support, it has been necessary to loosen the bolts, move the clamps or stops to the desired new position, and then retighten the bolts when the clamps or stops are in the selected adjusted location. Moreover, after the bolts have been tightened, it has not been possible to make small or fine adjustments in the positions of the clamps or stops relative to the support without again loosening the bolts, making the small or fine adjustments, and then retightening the bolts again thereby increasing the time, labor and expense required to install and adjust the clamps, stops and the like on the workpiece support.

An object of the present invention is to overcome the aforementioned as well as other disadvantages in prior devices of the indicated character, such as prior clamps, stops and the like and the means for mounting the same on a workpiece support, and to provide an improved adjustable jig particularly adapted for use in locating and maintaining the correct positional relationship between components of work during the assembly and manufacture thereof.

Another object of the present invention is to provide an improved means for adjustably mounting clamps, stops and the like on a workpiece support.

Another object of the present invention is to provide an improved adjustable jig incorporating improved means for mounting the jig on a workpiece support which means is self retaining and which permits installation and adjustment of the jig with a minimum of time, labor and expense.

Another object of the present invention is to provide an improved adjustable jig incorporating combined magnetic and mechanical means for adjustably mounting the jig on a workpiece support.

Another object of the present invention is to provide an improved adjustable jig incorporating improved means for adjusting the positional relationship of the jig with respect to a workpiece support.

Still another object of the present invention is to provide an improved adjustable jig that is economical to manufacture and assemble, durable, efficient, and reliable in operation.

The above as well as other objects and advantages of the present invention will become apparent from the following description, the appended claims and the accompanying drawings.

BRIEF DESCRIPTION OF THE DRAWINGS

FIG. 1 is a top plan view illustrating a plurality of adjustable jigs embodying the present invention, showing the same installed on a workpiece support adjacent a conventional roof truss configuration;

FIG. 2 is an enlarged top plan view of a portion of the structure illustrated in FIG. 1;

FIG. 3 is an enlarged top plan view of one of the embodiments of the present invention illustrated in FIG. 1;

FIG. 4 is a bottom plan view of the structure illustrated in FIG. 3;

FIG. 5 is a side elevational view, with portions in cross section, of the structure illustrated in FIG. 3;

FIG. 6 is a top plan view of another embodiment of the invention;

FIG. 7 is a side elevational view, with portions in cross section, of the structure illustrated in FIG. 6;

FIG. 8 is a top plan view of another embodiment of the invention;

FIG. 9 is a side elevational view, with portions in cross section, of the structure illustrated in FIG. 8;

DETAILED DESCRIPTION

Figure 10:
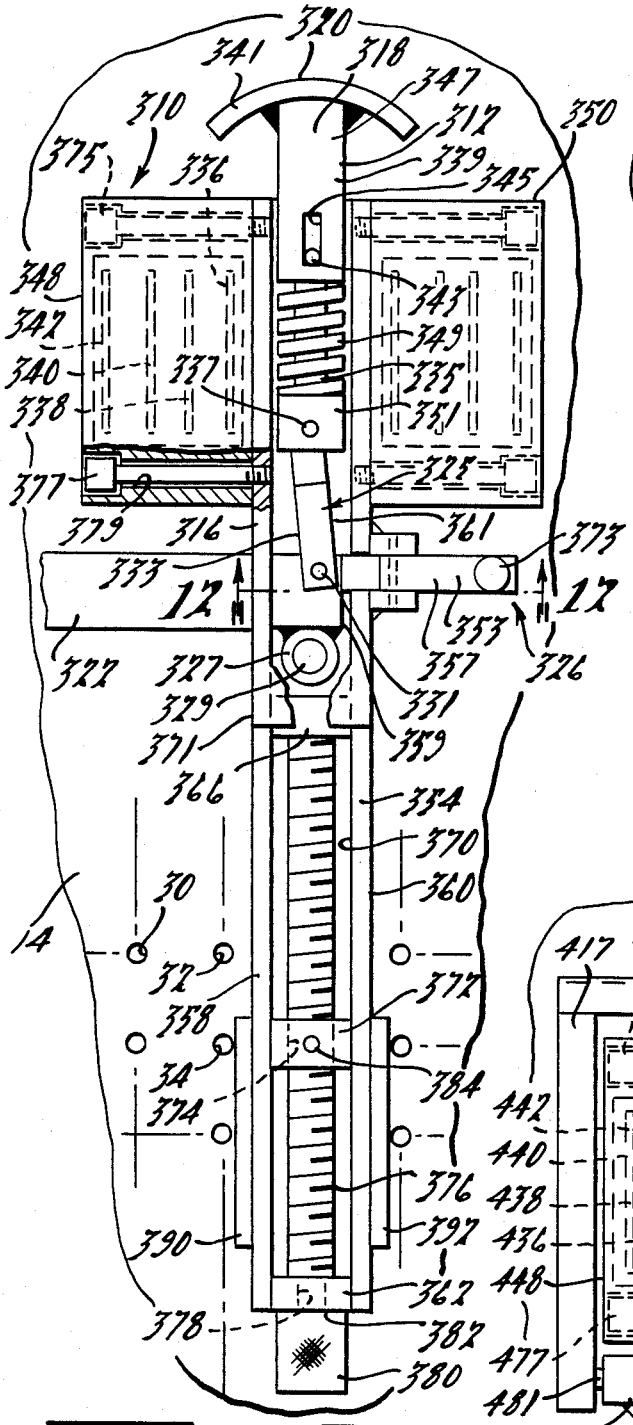
FIG. 10 is a top plan view of another embodiment of the present invention, with portions broken away for clarity of illustration, and illustrating the clamp mechanism in the locked position.

Referring to the drawings, one embodiment of the invention is illustrated in FIGS. 1 through 5 thereof, and is comprised of an adjustable jig, generally designated 10, incorporating a clamp, generally designated 12, that may be adjustably mounted on a work- piece support, generally designated 14. The clamp 12, which will be described hereinafter in greater detail, is intended to depict a wide variety of conventional clamps which are commercially available and which include a body 16, and a movable clamp 18 carried by the body 16 and having an abutment surface 20 at the free end thereof. A clamp actuating member 22 is provided which is connected to the movable clamp 18 and which enables the movable clamp 18 and its associated abutment surface 20 to be advanced into engagement with a workpiece, generally designated 24, as will be described hereinafter in greater detail. A clamp release means 26 is also provided which is operatively connected to the clamp 18, the clamp release means enabling disengagement of the clamp 18 from the workpiece when the work is completed as will also be described hereinafter in greater detail. The clamp 12, including the body 16, is preferably formed of steel or other suitable material having sufficient strength to withstand the forces exerted thereon. The workpiece support 14 is formed of magnetic material, such as steel, which may be in the form of a plate, and includes a substantially flat surface 28 upon which the jig 10 is mounted as will be described hereinafter in greater detail. The workpiece support 14 also defines a plurality of spaced passageways, such as 30, 32 and 34. The longitudinal axes of the passageways extend in a direction substantially perpendicular to the plane of the surface 28 and the passageways may be spaced at any desired distance relative to each other. For example, the passageways may be disposed in rows and columns with the longitudinal axes of the passageways spaced approximately one inch apart.

The adjustable jig 10 also includes a plurality of permanent magnets, such as 36, 38, 40 and 42, which are mounted in open bottom recesses 44 and 46 defined by housings 48 and 50, respectively. The housings 48 and 50, in turn, are mounted on opposite sides of and fixed to the body 16 of the clamp as shown in FIGS. 3 and 4. The housings 48 and 50 are formed of non-magnetic material, such as aluminum, and the magnets 36, 38, 40 and 42 are preferably retained in the recesses 44 and 46 defined by the housings 48 and 50 through the agency of a suitable potting compound 52. The permanent magnets disposed in each of the housings 48 and 50 may have a combined holding power of several hundred pounds acting in a direction perpendicular to the surface 28 of the workpiece support 14 when the magnets are disposed in engagement with the surface 28 of the workpiece support. It will be understood however that the holding power of the magnets in a direction parallel to the plane of the surface 28 is much less than the holding power of the magnets in a direction perpendicular to the surface 28.

As shown in FIGS. 3, 4 and 5, in this embodiment of the invention, a generally U-shaped base 54 is provided which is fixed to the end portion 56 of the body 16 of the clamp remote from the abutment surface 20. The generally U-shaped base 54 includes a pair of elongate, laterally spaced leg portions 58 and 60 which extend in spaced substantially parallel relationship and which are joined at one end thereof by a transverse portion 62 which is fixed to the adjacent ends of the leg portions 58 and 60 by any suitable means. The opposite ends of the legs 58 and 60 are fixed to the end portion 56 of the body of the clamp by a bolt 66 which passes through the legs 58 and 60 and through the body 16 of the clamp, the bolt 66 being retained by a nut 68.

The base 54 defines an elongate channel 70 which is open at the top and bottom of the base while the ends of the channel 70 are closed at one end by the body 16 of the clamp and at the opposite end by the transverse member 62. An adjustable block 72, in the form of a parallelepiped, is provided which is mounted for longitudinal movement in the channel 70 defined by the base 54, the block 72 defining an internally threaded passageway 74 adapted to receive an elongate externally threaded screw 76 which extends longitudinally of the channel. One end portion of the screw 76 bears against the end portion 56 of the body of the clamp while the opposite end portion of the screw passes freely through a non-threaded opening 78 defined by the transverse portion 62 of the base, the screw being constrained against longitudinal movement by a knurled handle 80 which bears against the outer surface 82 of the transverse portion 62 of the base. With such a construction, rotation of the screw 76 through the agency of the handle 80 in one direction causes the block 72 to advance in the channel toward the body of the clamp while rotation of the screw in the opposite direction causes the block to retract in the channel toward the transverse portion 62 of the base.

A pin 84 is provided which is fixed to the block 72 and which projects outwardly therefrom as illustrated in FIG. 5. The pin 84 is preferably formed of steel or other suitable material having sufficient strength to withstand the forces exerted thereon and the pin is adapted to be received selectively in any of the passageways such as 30, 32 and 34 defined by the workpiece support 14.

With such a construction, the pin 84 may be inserted in any one of the passageways defined by the workpiece support 14 whereby the base 54 and the clamp 12 are located in the approximate desired position for use in clamping components of the workpiece. The handle 80 may then be manually rotated so as to advance or retract the block 72 and the pin 84 carried thereby whereby the abutment surface 20 may be located at the precise desired position. The above described construction also permits the entire jig 10 including the base 54 and the clamp 12 to be moved angularly about the longitudinal axis of the pin 84 to compensate for any irregularities that may be presented by the various components of the workpiece. The permanent magnets prevent the clamp 12, incorporated in the jig 10, from lifting off of the surface 28 of the workpiece support 14 while the pin 84 prevents longitudinal movement of the clamp in a plane parallel to the plane of the surface 28 of the workpiece support.

FIG. 1 illustrates the manner in which clamps 12 incorporated in jigs embodying the present invention may be utilized to clamp components, such as chords 86 and webs 88 of a wooden truss, generally designated 90, between the clamp and a stop 112 provided on the workpiece support 14. Stops 112 embodying the present invention will also be described hereinafter in greater detail, but it will be understood that other types of stops may be utilized if desired.

FIG. 2 illustrates the manner in which connector plates 94 are embedded in the wooden components of the truss configuration at the joints of the truss components while the truss components are held on the workpiece support in the clamped condition whereby the components of the truss configuration are permanently joined together.

If it is desired to manufacture a different type of truss utilizing components with different dimensions, the jig 10 may be easily moved to another position on the workpiece support by tilting the permanent magnets and simultaneously lifting the pin from the passageway in which the pin has previously been inserted in the workpiece support so that the magnets are released from the workpiece support. The entire jig including the base 54 and the clamp 12 may then be moved to a new location on the workpiece support after which the pin 84 is inserted in a passageway at the new desired location and the clamp adjusted to the exact desired position in the manner previously described.

Another embodiment of the invention is illustrated in FIGS. 1, 6 and 7, and is comprised of an adjustable jig, generally designated 110, incorporating a stop, generally designated 112, that may be adjustably mounted on the workpiece support 14. The stop 112 illustrated in the drawings is intended to depict a wide variety of conventional stops and includes a body 116 having an abutment surface 120 on one side thereof adapted to engage a workpiece, such as the workpiece 24. The stop 112 is preferably formed of steel or other suitable material having sufficient strength to withstand the forces exerted thereon.

The adjustable jig 110 includes the plurality of permanent magnets, such as 36, 38, 40 and 42, which are mounted in the open bottom recesses 44 and 46 defined by the housings 48 and 50, respectively. The housings 48 and 50, in this embodiment of the invention, are mounted on the rear side of the stop body 116 which is opposite the abutment surface 120 as shown in FIGS. 6 and 7. As previously mentioned, the housings 48 and 50 are formed of non- magnetic material, such as aluminum, and the magnets such as 36, 38, 40 and 42 are preferably retained in the recesses 44 and 46 defined by the housings 48 and 50 through the agency of a suitable potting compound 52. The permanent magnets disposed in each of the housings 48 and 50 may have a combined holding power of several hundred pounds acting in a direction perpendicular to the surface 28 of the workpiece support 14 when the magnets are disposed in engagement with the surface 28 of the workpiece support 14. It will be understood however that the holding power of the magnets in a direction parallel to the plane of the surface 28 is much less than the holding power of the magnets in a direction perpendicular to the surface 28.

As shown in FIGS. 6 and 7, in this embodiment of the invention, a base 154 is provided which is fixed to the rear side 156 of the stop body 116 opposite the abutment surface 120. In this embodiment of the invention, the base 154 includes a pair of elongate laterally spaced leg portions 158 and 160 which extend in spaced substantially parallel relationship and which are joined at one end thereof by a transverse portion 162 which is fixed to the adjacent ends of the leg portions 158 and 160 by any suitable means. The opposite end portions of the legs 158 and 160 are also fixed to a bearing block 165 by any suitable means.

The base 154 defines an elongate channel 170 which is open at the top and bottom of the base while the ends of the channel 170 are closed at one end by the bearing block 165 and at the opposite end by the transverse member 162. An adjustable block 172, in the form of a parallelepiped, is provided which is mounted for longitudinal movement in the channel 170 defined by the base 154, the block 172 defining an internally threaded passageway 174 adapted to receive an elongate externally threaded screw 176 which extends longitudinally of the channel 170. One end portion of the screw 176 bears against the bearing block 165 while the opposite end portion of the screw 176 passes freely through a non-threaded opening 178 defined by the transverse portion 162 of the base, the screw being constrained against longitudinal movement by a knurled handle 180 which bears against the outer surface 182 of the transverse portion 162 of the base. With such a construction, rotation of the screw 176 through the agency of the handle 180 in one direction causes the block 172 to advance in the channel toward the body of the stop while rotation of the screw in the opposite direction causes the block to retract in the channel toward the transverse portion 162 of the base.

A pin 184, similar to the pin 84 previously described, is provided which is fixed to the block 172 and which projects outwardly therefrom. The pin 184 is also preferably formed of steel or other suitable material having sufficient strength to withstand the forces exerted thereon and the pin is adapted to be received selectively in any of the passages, such as 30, 32 and 34, defined by the workpiece support 14. With such a construction, the pin 184 may be inserted in any one of the passageways defined by the workpiece support 14 whereby the base 154 and the stop 112 are located in the approximate desired position for use in holding components of the workpiece. The handle 180 may then be manually rotated so as to advance or retract the block 172 and the pin 184 carried thereby whereby the abutment surface 120 may be located at the precise desired position. The above described construction also permits the entire jig 110 including the base 154 and the stop 112 to be moved angularly about the longitudinal axis of the pin 184 to compensate for any irregularities that may be presented by the various components of the workpiece. The permanent magnets prevent the stop 112, incorporated in the jig 110, from lifting off of the surface 28 of the workpiece support while the pin 184 prevents longitudinal movement of the stop in a plane parallel to the plane of the surface 28 of the workpiece support 14.

FIG. 1 illustrates the manner in which stops 112 incorporated in jigs embodying the present invention may be utilized to hold components, such as the chord 86 and the web 88 of the wooden truss 90 between a clamp and an associated stop 112 provided on a workpiece support 14.

If it is desired to manufacture a different type of truss utilizing components with different dimensions, the entire jig including the stop 112 may be easily moved to another position on the workpiece support by tilting the permanent magnets and simultaneously lifting the pin 184 from the passageway in which the pin has previously been inserted in the workpiece support so that the magnets are released from the workpiece support. The entire jig including the base 154 and the stop 112 may then be moved to a new location on the workpiece support after which the pin 184 may be inserted in a passageway at the desired new location and the stop adjusted to the exact desired position in the manner previously described.

Another embodiment of the invention is illustrated in FIGS. 8 and 9, and is comprised of an adjustable jig, generally designated 210, incorporating the clamp 12, that may be adjustably mounted on the workpiece support 14. The clamp 12 includes the body 16, the movable clamp 18 carried by the body 16 and the abutment surface 20 disposed at the free end of the moveable clamp 18. The clamp 12 also includes the actuating member 22 which enables the clamp 18 and its associated abutment surface 20 to be advanced into engagement with a workpiece. The clamp also includes the clamp release means 26 which enables disengagement of the clamp 18 from the workpiece when the work is completed.

This embodiment of the invention also includes the plurality of permanent magnets, such as 36, 38, 40 and 42, which are mounted in the open bottom recesses 44 and 46 defined by the housings 48 and 50, respectively, in the manner previously described. The housings 48 and 50, in turn, are mounted on opposite sides of and fixed to the body 16 of the clamp as previously described.

As shown in FIGS. 8 and 9, in this embodiment of the invention, the bases, such as 54 and 154, are eliminated, and a pin 284 is provided which extends through the rear end portion of the body 16 of the clamp and outwardly therefrom whereby the pin may be received selectively in any of the passageways such as 30, 32 and 34 defined by the workpiece support 14. With such a construction, the pin 284 may be inserted in any one of the passageways defined by the workpiece support 14 whereby the jig 210 may be located in the desired position on the workpiece support for use in clamping components of the workpiece. It will be appreciated that since this embodiment of the invention does not include means for adjusting the position of the pin 284 relative to the abutment surface 20, closer spacing of the passageways, such as 30, 32 and 34 defined by the workpiece support 14, may be provided to enable precise positioning of the jig on the workpiece support.

If it is desired to manufacture a different type of roof truss utilizing components with different dimensions, the jig 210 may be easily moved to another position on the workpiece support by lifting the pin 284 from the passageway in which the pin has previously been inserted, and tilting the permanent magnets so that the magnets are released from the workpiece support. The entire jig may then be moved to a new location on the workpiece support after which the pin 284 may be inserted in a passageway at the new desired location. It will also be understood that a stop, as distinguished from a clamp, may be constructed in the same manner as this embodiment of the invention utilizing the permanent magnets and a fixed position pin, as distinguished from a movable position pin as described hereinabove.

Figure 11:
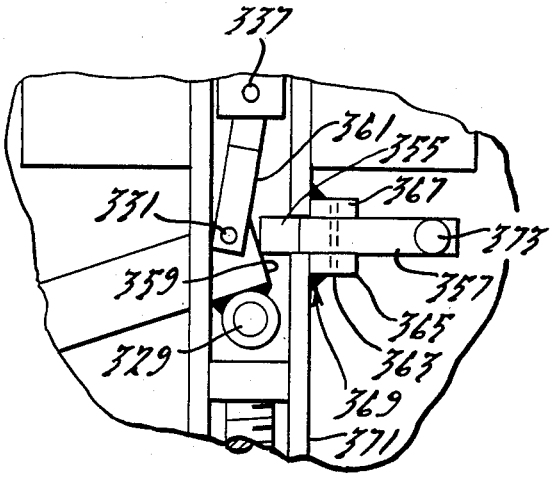
FIG. 11 is a top plan view of a portion of the structure illustrated in FIG. 10, and illustrating the clamp mechanism in the released position.
Figure 13:
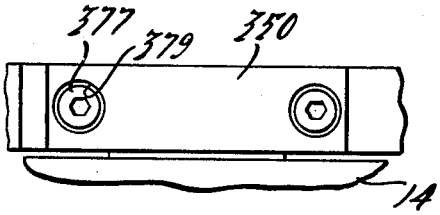
FIG. 13 is a side elevational view of a portion of the structure illustrated in FIG. 10.
Figure 15:
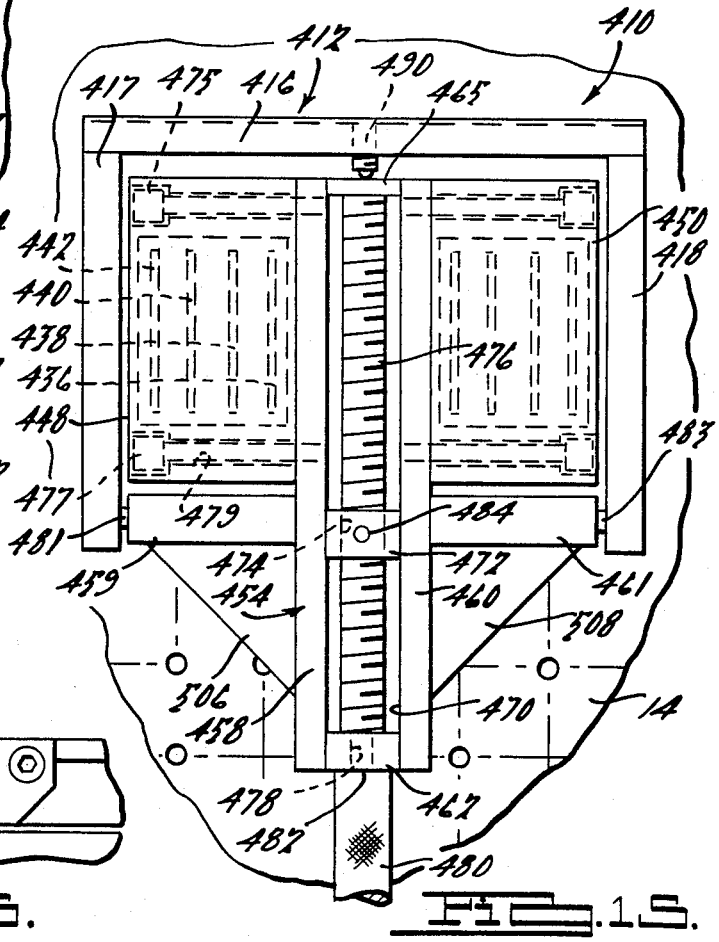
FIG. 15 is a top plan view of still another embodiment of the present invention.
Figure 16:
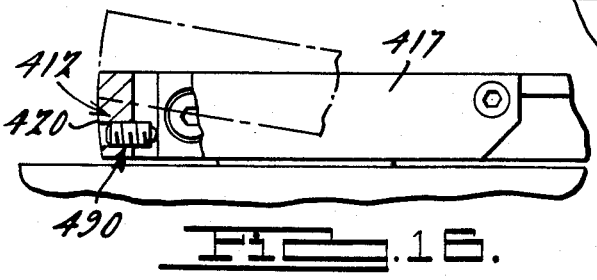
FIG. 16 is a side elevational view of a portion of the structure illustrated in FIG. 13, and showing, in dotted lines, the stop in a raised position.
Figure 12:
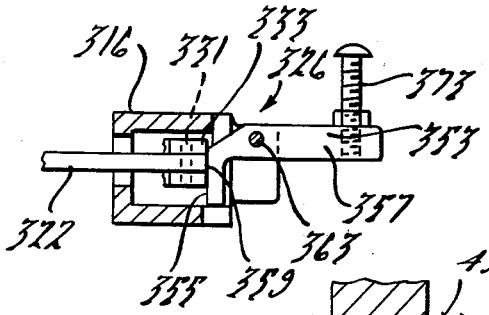
FIG. 12 is a cross sectional view of the clamp mechanism illustrated in FIG. 10, taken on the line 12—12 thereof.
Figure 17:
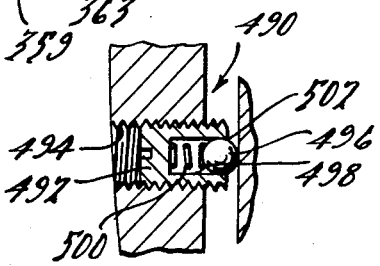
FIG. 17 is an enlarged cross sectional view of the detent incorporated in the embodiment of the invention illustrated in FIG. 15.
Figure 18:
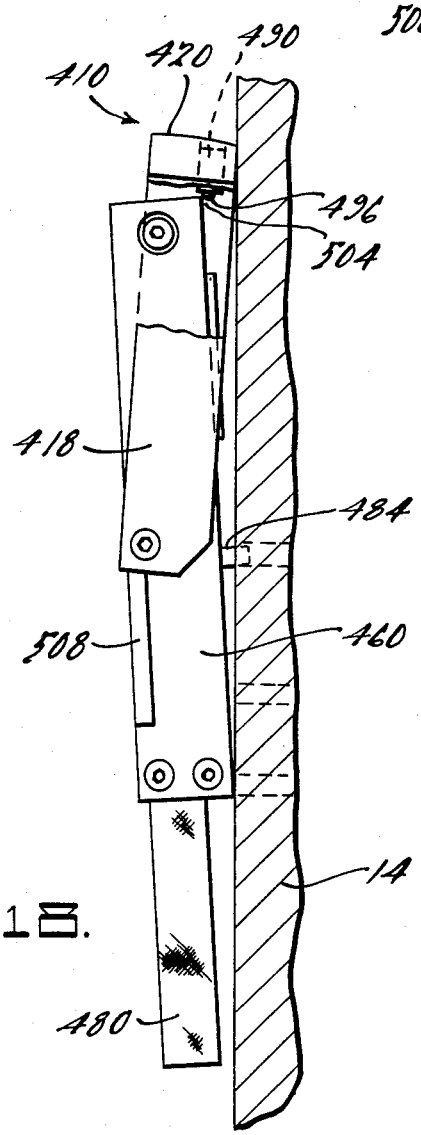
FIG. 18 is a side elevational view of the structure illustrated in FIG. 15, showing the same in an adjusting position.

Another embodiment of the invention is illustrated in FIGS. 10 through 14, and is comprised of an adjustable jig, generally designated 310, which incorporates a clamp 312, and which may be adjustably mounted on the workpiece support 14. The clamp 312 includes a box beam section body 316, and a moveable clamp 318 carried by the body 316 and having an abutment surface 320 at the free end thereof. A clamp actuating member 322 is provided which is connected to the moveable clamp 318 through the agency of an over-center locking and release mechanism, generally designated 325, whereby the clamp 318 and its associated abutment surface 320 may be manually advanced into clamping engagement with and released from a workpiece. As shown in FIGS. 10, 11 and 12, the clamp actuating member 322, which is constructed in the form of a lever, carries a journal 327 which is welded or otherwise fixed to the lever, the journal being mounted for pivotal movement on a pin 329 fixed to the bottom wall of the box beam sectioned body 316. The clamp actuating member 322 is also pivotally connected, by a pin 331, to one end portion of a bifurcated arm 333 while the opposite end portion of the arm 333 is pivotally connected to a rod 335 by a pin 337. The opposite end portion of the rod 335 extends into a box beam section support member 339 forming part of the clamp 312, the curved section 341 of the clamp, which defines the surface 320, being welded or otherwise fixed to the support member 339. The rod 335 is connected to the support member 339 through the agency of a pin 343 which is fixed to the rod 335 and which extends into a slot 345 defined by the top wall 347 of the support member 339 whereby limited movement of the rod 335 relative to the support member 339 is permitted. A coil spring 349 is provided one end portion of which bears against the inner end of the support member 339 while the opposite end portion of the spring bears against a split ring 351 which surrounds the inner end portion of the rod 335 and the adjacent portion of the arm 333. The split ring 351 is connected to both the rod 335 and the arm 333 by the pin 337. The spring 349 enables the jig to accommodate dimensional tolerances of dimensional lumber.

With the components of the clamp and over-center locking and release mechanism 325 disposed in the positions illustrated in FIG. 10, the forces exerted on the clamp are transmitted through the pins 343, 337 and 327, the axis of the pin 331 being over-center or to the right, as viewed in FIG. 10, of a line extending between the axes of the pins 337 and 327. A clamp release means 326 is also provided which enables disengagement of the clamp 318 from the workpiece when the work is completed. The clamp release means 326 is comprised of a generally L-shaped lever 353 having a flange portion 355 and a leg portion 357, the flange portion 355 being adapted to bear against the end 359 of the lever 322 and the side 361 of the arm 333. The leg portion 357 is pivotally connected, by a pin 363 to the flange portions 365 and 367 of a generally U-shaped bracket, generally designated 369, which is welded or otherwise fixed to the side wall 371 of the body 316. A manual actuating knob 373 is fixed to the outer end portion of the leg 357. With such a construction, pressing the knob 373 causes the L-shaped lever 353 to pivot about the axis of the pin 363 so that the flange portion 355 of the lever bears against the end 359 of the lever 322 and the side 361 of the arm 333 and pushes the pin 331 over-center and to the left, as viewed in FIGS. 10 and 11, so as to release the clamp from the workpiece. The structure, manner of operation and results obtained by the clamp actuating member 22 and the clamp release means 26, previously described, are the same as the structure, manner of operation and results obtained by the clamp actuating member 322 and the clamp release means 326, respectively.

The clamp 312 and the body 316 are preferably formed of steel or other suitable material having sufficient strength to withstand the forces exerted thereon. In this embodiment of the invention, the adjustable jig 310 also includes a plurality of permanent magnets, such as 336, 338, 340 and 342 which are mounted in housings 348 and 350, respectively. The housings 348 and 350, in turn, are mounted on opposite sides of and fixed to the body 316 through the agency of bolts such as 375 and 377 the shank portions of which extend through counterbored passageways 379 defined by the housings. The internal diameters of the counterbored passageways 379 are slightly larger in diameter than the outside diameters of the bolts so that limited movement of the housings and the magnets carried thereby is permitted relative to the body 316. For example the internal diameters of the passageways may be 1/16 of an inch greater in diameter than the maximum corresponding dimensions of the associated head and shank portions of the associated bolt. Such a construction enables limited movement of the housings and associated magnets relative to the body 316 to accommodate irregularities in the surface of the workpiece support 14. The housings 348 and 350 are preferably formed of non-magnetic material, such as aluminum, and the magnets 336, 338, 340 and 342 are preferably retained in the housings through the agency of a suitable potting compound. The permanent magnets disposed in each of the housings 348 and 350 may have a combined holding power of several hundred pounds acting in a direction perpendicular to the surface 28 of the workpiece support 14 when the magnets are disposed in engagement with the surface 28 of the workpiece support 14. It will be understood however that the holding power of the magnets in a direction parallel to the plane of the surface 28 is much less than the holding power of the magnets in a direction perpendicular to the surface 28.

In this embodiment of the invention, a generally U-shaped base portion 354 is provided which is formed integrally with the body 316. The generally U-shaped base portion 354 includes a pair of elongate, laterally spaced leg portions 358 and 360 which extend in spaced substantially parallel relationship and which are joined at one end thereof by a transverse portion 362 which is fixed to the adjacent end portions of the legs 358 and 360 by any suitable means. The opposite end portion of the legs 358 and 360 are formed integrally with the body 316.

The base portion 354 of the jig 310 defines an elongate channel 370 which is open at the top and bottom of the base portion while the ends of the channel 370 are closed at one end by the transverse member 362 and at the opposite end by a block 366. An adjustable block 372, in the form of a parallelepiped, is provided which is mounted for longitudinal movement in the channel 370 defined by the base portion 354, the block 372 defining an internally threaded passageway 374 adapted to receive an elongate externally threaded screw 376 which extends longitudinally of the channel. One end portion of the screw 376 bears against the block 366 while the opposite end portion of the screw passes freely through a non-threaded opening 378 defined by the transverse portion 362, the screw being constrained against longitudinal movement by a knurled handle 380 which bears against the outer surface 382 of the transverse portion 362. With such a construction, rotation of the screw 376 through the agency of the handle 380 in one direction causes the block 372 to advance in the channel toward the clamp 312 while rotation of the screw in the opposite direction causes the block to retract in the channel toward the transverse portion 362.

Figure 14:
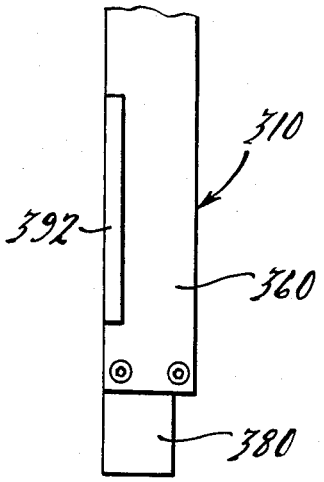
FIG. 14 is a side elevational view of the handle end portion of the structure illustrated in FIG. 10.

A pin 384 is provided which is fixed to the block 372 and which projects outwardly therefrom. The pin 384 is preferably formed of steel or other suitable material having sufficient strength to withstand the forces exerted thereon and the pin 384 is adapted to be received selectively in any of the passageways such as 30, 32 and 34 defined by the workpiece support 14. As shown in FIGS. 10 and 14, ribs 390 and 392 are fixed to opposite sides of the base 316 near the handle 380 to facilitate manual lifting of the jig 310. With such a construction, the pin 384 may be inserted in any one of the passageways defined by the workpiece support 14 whereby the jig 310, including the clamp 312, is located in the approximate desired position for use in clamping components of the workpiece. The handle 380 may then be manually rotated so as to advance or retract the block 372 and the pin 384 carried thereby whereby the abutment surface 320 may be located at the precise desired position. The above described construction also permits the entire jig 310 to be moved angularly about the longitudinal axis of the pin 384 to compensate for any irregularities that may be presented by the various components of the workpiece. The permanent magnets prevent the clamp 312 incorporated in the jig 310 from lifting off of the surface 28 of the workpiece support 14 while the pin 384 prevents longitudinal movement of the jig 310 in a plane parallel to the plane of the surface 28 of the workpiece support.

If it is desired to manufacture a different type of truss utilizing components with different dimensions, the jig 310 may be easily moved to another position on the workpiece support by tilting the permanent magnets and simultaneously lifting the pin 384 from the passageway in which the pin has previously been inserted in the workpiece support so that the magnets are released from the workpiece support. The entire jig 310 may then be moved to a new location on the workpiece support after which the pin 384 is inserted in a passageway at the new desired location and the clamp adjusted to the exact desired position in the manner previously described. As previously mentioned, since the housings which carry the magnets are connected to the body 316 in a manner which permits limited relative movement between the housings and the body, the magnets can accommodate irregularities in the surface of the workpiece support.

Another embodiment of the invention is illustrated in FIGS. 15 through 18, and is comprised of an adjustable jig, generally designated 410, which may be adjustably mounted on the workpiece support 14 and which incorporates a stop, generally designated 412. In this embodiment of the invention, the stop 412 is of generally channel shaped configuration, in plan view, and includes a web portion 416 and integral flange portions 417 and 418, the web portion 416 having a curved abutment surface 420 adapted to engage a workpiece. The stop 412 is preferably formed of steel or other suitable material having sufficient strength to withstand the forces exerted thereon. The adjustable jig 410 also includes a plurality of permanent magnets, such as 436, 438, 440 and 442 which are mounted in housings 448 and 450, respectively. The housings 448 and 450, in turn, are mounted on opposite sides of and fixed to a base 454 through the agency of bolts, such as 475 and 477, the shank portions of which extend through counterbored passageways 479 defined by the housings. The internal diameters of the counterbored passageways 479 are slightly larger in diameter than the outside diameters of the bolts so that limited movement of the housings and magnets carried thereby is permitted relative to the base 454. For example, the internal diameters of the counterbored passageways may be 1/16 of an inch greater in diameter than the maximum corresponding dimensions of the associated head and shank portions of the associated bolt. Such a construction enables limited movement of the housings and the magnets carried thereby relative to the base 454 to accommodate irregularities in the surface of the workpiece support 14. The housings 448 and 450 are preferably formed of non-magnetic material, such as aluminum, and the magnets 436, 438, 440 and 442 are preferably retained in the housings through the agency of a suitable potting compound. The permanent magnets disposed in each of the housings 448 and 450 may have a combined holding power of several hundred pounds acting in a direction perpendicular to the surface 28 of the workpiece support 14 when the magnets are disposed in engagement with the surface 28 of the workpiece support 14, the holding power of the magnets in a direction parallel to the plane of the surface 28 being less than the holding power of the magnets in a direction perpendicular to the surface 28.

In this embodiment of the invention, the base 454 includes a pair of elongate laterally spaced leg portions 458 and 460 which extend in spaced parallel relationship and which are joined at one end thereof by a transverse portion 462 which is fixed to the adjacent ends of the leg portions 458 and 460 by any suitable means. The opposite end portions of the legs 458 and 460 are also fixed to a bearing block 465 by any suitable means.

The base 454 defines an elongate channel 470 which is open at the top and bottom of the base while the ends of the channel 470 are closed at one end by the bearing block 465 and that the opposite end by the transverse member 462. An adjustable block 472, in the form of a parallelpiped, is provided which is mounted for longitudinal movement in the channel 470 defined by the base 454, the block 472 defining an internally threaded passageway 474 adapted to receive an elongate externally threaded screw 476 which extends longitudinally of the channel 470. One end portion of the screw 476 bears against the bearing block 465 while the opposite end portion of the screw 476 passes freely through a non-threaded opening 478 defined by the transverse portion 462 of the base, the screw being constrained against longitudinal movement by a knurled handle 480 which bears against the outer surface 482 of the transverse portion 462 of the base. With such a construction, rotation of the screw 476 through the agency of the handle 480 in one direction causes the block 472 to advance in the channel toward the stop 412 while rotation of the screw in the opposite direction causes the block to retract in the channel toward the transverse portion 462 of the base.

A pin 484, similar to the pins previously described, is provided which is fixed to the block 472 and which projects outwardly therefrom. The pin 484 is also preferably formed of steel or other suitable material having sufficient strength to withstand the forces exerted thereon and the pin is adapted to be received selectively in any of the passages, such as 30, 32 and 34, defined by the workpiece support 14. With such a construction, the pin 484 may be inserted in any one of the passageways defined by the workpiece support 14 whereby the base 454 and the stop 412 are located in the approximate desired position for use in holding components of the workpiece. The handle 480 may then be manually rotated so as to advance or retract the block 472 and the pin 484 carried thereby whereby the abutment surface 420 may be located at the precise desired position.

In this embodiment of the invention, the base 454 also includes integral outwardly projecting block portions 459 and 461 which extend in a direction perpendicular to the leg portions 458 and 460 and which are integrally joined thereto by any suitable means. The flange portions 417 and 418 of the stop 412 are pivotally connected to the block portions 459 and 461 through the agency of axially aligned pivot pins 481 and 483 fixed to the block portions 459 and 461, respectively. The radius of curvature of the surface 420 of the stop 412 extends from the aligned axes of the pivot pins 481 and 483. With such a construction, pressure exerted against a workpiece remains constant if the stop 412 is pivoted upwardly, as shown in dotted lines in FIG. 16, with the result that a workpiece may be lifted slightly off the support 14 to enable a connector plate to be inserted thereunder while constant pressure is exerted on the workpiece by the stop 412.

In this embodiment of the invention, a detent, generally designated 490, is provided having an externally threaded body portion 492 which threadably engages an internally threaded passageway 494 defined by the web portion 416 of the stop 412. The detent 490 also includes a ball 496 which is disposed in a blind passageway 498 and biased by a spring 500, the end 502 of the body being crimped or otherwise reduced in diameter to retain the ball in the passageway 498. With such a construction, the stop 412 may be pivoted or cocked toward the workpiece support 14 about the aligned axes of the pivot pins so that the ball 496 of the detent engages the lower edge 504 of the bearing block 465 to hold the stop in the position illustrated in FIG. 18. With the stop 412 in such a position, the magnets are held a slight distance away from the workpiece support 14 so that the entire jig 410 may be moved easily relative to the workpiece support 14 and manually positioned at the desired location on the workpiece support. The magnets are then pushed downwardly to hold the jig in the selected position. The above described construction also permits the entire jig 410 including the base 454 and the stop 412 to be moved angularly above the longitudinal axis of the pin 484 to compensate for any irregularities that may be presented by the various components of the workpiece. The permanent magnets prevent the stop 412, incorporated in the jig 410, from lifting off of the surface 28 of the workpiece support while the pin 484 prevents longitudinal movement of the stop in a plane parallel to the plane of the surface 28 of the workpiece support 14, generally triangularly shaped gusset plates 506 and 508, disposed at the intersections of the block portions 459 and 461 with the leg portions 458 and 460, respectively, being provided to facilitate manual lifting of the jig 410 and manual manipulation thereof relative to the support 14.

While preferred embodiments of the invention have been illustrated and described, it will be understood that various changes and modifications may be made without departing from the spirit of the invention.

What is claimed is:

1. An adjustable jig for use in maintaining the correct positional relationship between components of work during assembly thereof on a workpiece support, said support being in the form of a flat plate formed of magnetic material and defining a plurality of spaced passageways opening upon an exterior surface of said support, said jig comprising, in combination, a base, permanent magnet means carried by said base and magnetically attractable to said support, said base defining an elongate channel, an adjustable block mounted for longitudinal movement in the channel defined by said base, pin means carried by said block and adapted to be received selectively in the passageways defined by said support to mechanically connect said base to said support, and means for advancing and retracting said block in the channel defined by said base.

2. The combination as set forth in claim 1, said permanent magnet means including a plurality of permanent magnets disposed on opposite sides of said base.

3. The combination as set forth in claim 2 including non-magnetic means housing said permanent magnets.

4. The combination as set forth in claim 1, said means for advancing and retracting said block including screw means.

5. The combination as set forth in claim 4, including means for manually actuating said screw means.

6. The combination as set forth in claim 1, said base carrying releasable clamp means adapted to engage a workpiece.

* * * * *